US007789504B2

(12) United States Patent
Tombs et al.

(10) Patent No.: US 7,789,504 B2
(45) Date of Patent: Sep. 7, 2010

(54) INK JET PRINTING USING A COMBINATION OF NON-MARKING AND MARKING INKS

(75) Inventors: Thomas Nathaniel Tombs, Rochester, NY (US); Donald Saul Rimai, Webster, NY (US); Robert Edward Zeman, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 434 days.

(21) Appl. No.: 11/445,714

(22) Filed: Jun. 2, 2006

(65) Prior Publication Data

US 2007/0279473 A1 Dec. 6, 2007

(51) Int. Cl.
*B41J 2/01* (2006.01)

(52) U.S. Cl. ..... 347/103; 347/107

(58) Field of Classification Search ..... 347/16, 347/103, 105, 107, 100

See application file for complete search history.

(56) References Cited

U.S. PATENT DOCUMENTS

| | | | | |
|---|---|---|---|---|
| 5,539,440 | A * | 7/1996 | Higuchi et al. | 347/112 |
| 6,481,840 | B1 * | 11/2002 | Mueller et al. | 347/88 |
| 6,529,220 | B1 | 3/2003 | Matsumoto | |
| 7,165,495 | B2 * | 1/2007 | Adachi | 101/483 |
| 2003/0066751 | A1 | 4/2003 | May et al. | |
| 2003/0227503 | A1 | 12/2003 | Klausbruckner et al. | |

* cited by examiner

*Primary Examiner*—Stephen D Meier
*Assistant Examiner*—Alexander C Witkowski
(74) *Attorney, Agent, or Firm*—Lawrence P. Kessler

(57) ABSTRACT

An ink jet device selectively ejects droplets of non-marking liquid ink into cells of a printing member in a desired latent negative image pattern. Certain cells of the printing member are filled with pigmented ink to create a desired image. An electrical bias is applied for fractionating pigment in the pigmented ink from liquid and transferring an image-wise pigmented ink pattern from the printing member to a receiving member, leaving behind a substantial portion of liquid. The receiver can be an intermediate member whereby the image-wise ink pattern is transferred from the intermediate member to a final receiver, while such receiver is in operative association with said intermediate member.

18 Claims, 8 Drawing Sheets

60
14
14
60
62
60
62
62
62
60
62
62
62
62
60
60
60
22
14

INK JET PRINTING USING A COMBINATION OF NON-MARKING AND MARKING INKS

FIELD OF THE INVENTION

This invention relates in general to ink jet printing, and more particularly to ink jet printing using a combination of non-marking and marking inks.

BACKGROUND OF THE INVENTION

High-resolution digital input imaging processes are desirable for superior quality printing applications, especially those requiring that changes be made from one print to the next or those where relatively short numbers of prints are to be made. As is well known, such processes may include electrostatographic processes using small-particle dry toners, e.g., having particle diameters less than about 7 micrometers, electrostatographic processes using solvent based liquid developers (also referred to as liquid toners) in which the particle size is typically on the order of 0.1 micrometer or less, and ink-jet processes using aqueous or solvent based inks.

The most widely used high-resolution digital commercial electrostatographic processes involve electrophotography. Although capable of high process speeds and excellent print quality, electrophotographic processes using dry or liquid toners are inherently complicated, and require expensive, large, complex equipment. Moreover, due to their complex nature, electrophotographic processes and machines tend to require significant maintenance.

Ink jet technology may be used to deposit fluid materials on substrates and has numerous applications, mainly in printing. However, to avoid running and smearing of the ink droplets, the paper used in an ink jet printer must be porous, thereby restricting the papers that can be used and virtually eliminating the use of high quality graphic arts papers. In addition, the absorption of the ink by the paper limits the density of the images that can be produced. Finally, drying of ink requires a large amount of energy and would produce an inordinate amount of water or solvent vapors if used in high volume print engines. In addition, to avoid clogging ink jet heads, most ink jet inks include a dye dispersed in a solvent such as water or alcohol. However, dyes are subject to fading. Pigments are more resistant to fading, but are particulate and tend to clog ink jet heads. To avoid clogging, larger nozzles can be made. This however, results in larger ink droplets being formed, thereby reducing image resolution and quality.

Ink jet printing suffers from a number of drawbacks. Ink jet printing is typically slower than traditional offset printing. This is especially true for process color printing. For example, the linear printing speed of ink jet printing is typically of the order of 10 times slower than can be achieved in offset printing. This represents a major issue limiting the implementation of ink jet technology in industrial printing systems. The ink jet printing speed limit is dictated by the rate at which ink jet nozzles can eject ink in discrete controllable amounts. This rate is at present on the order of 20,000 pulses per second for drop-on-demand (DOD) ink jet printers. This limits state of the art DOD ink jet printers to print rates on the order of 2 pages per second. Continuous ink jet printing can be performed more quickly. However, at high speeds, the results tend to be poor due to the difficulties mentioned above.

Another limitation of printing at high speed with ink jet technology arises from the amount of liquid used in ink jet printing. Ink jet inks typically have a low concentration of colorant, predicated by the fine density variations required for producing good image quality. Thus, the image on the receiver has relatively large amounts of ink, which need to be dried before the image is usable. At high speeds, this drying step is complex and energy-intensive.

Ink jet printing currently cannot achieve printing quality as high as can be achieved using offset printing techniques. Ink jet printing is often characterized by a distinctive banding pattern that is repeated over the printed image. This may be traced to the arrangement of the ink jet nozzles in the printing head. Relatively small nozzle misalignments or off-center emission of droplets can cause banding. As the printing head is translated laterally across the width of the printing surface, the visual imperfections are periodically repeated. This produces banding or striping which is characteristic of ink jet printers. A number of approaches exist to control banding. These approaches reduce throughput of the printer.

Print quality of ink jet printers is also reduced by "wicking" or "running" of the ink jet inks. The low-viscosity inks typically employed in ink jet printers tend to "run" along the fibers of certain grades of paper. This phenomenon leads to reduced quality printing, particularly on the grades of paper desirable in high-volume printing. Wicking can cause printed dots to become much larger than the droplet of ink emerging from the ink jet nozzle. Wicking can also reduce the brightness of the image, as the some of the colorant in the image gets wicked below the surface, thus not contributing adequately to image brightness.

It is possible to reduce wicking by printing on specially treated paper receivers. However, such paper tends to be undesirably expensive. Furthermore, in order to produce prints that resemble photographic prints, a type of receiver that is commonly used has a polymer layer to mimic the resin-coated photographic paper. As polymers do not absorb water or the carrier fluid of ink, the polymer layer has to incorporate voids or channels to "absorb" the relatively large amount of ink in a typically high-coverage pictorial image, which increases the cost and complexity of the receiver.

The matter of failure in ink jet nozzles is also deserving of attention. Various approaches exist for detecting faulty ink jet nozzles and for readdressing the ink jet printing head to permit other nozzles to perform the tasks of faulty nozzles. This includes various redundancy schemes. Again, these usually have the effect of slowing down the net printing process speed. In many cases the redundancy is managed at printing head, requiring backups for entire printing heads. This adds to the cost of the technology per printed page and again limits the industrial implementation of the technology.

Another important problem is the presence of fluid in the image. Prior art describes forming the image on an intermediate, then transferring the image to a receiver. U.S. Pat. No. 5,099,256 discloses the use of a cylinder specifically coated with a silicone polymeric material in combination with a drop-on-demand print head. U.S. Pat. No. 6,736,500 discloses the use of a coagulating agent that increases the viscosity of the ink jet ink to improve transfer and image durability. U.S. Pat. Nos. 6,755,519 and 6,409,331 teach methods for increasing ink viscosity such as via UV cross-linking or evaporation. None of these patents address the formation of a multi-color image.

U.S. Pat. Nos. 6,761,446; 6,767,092; 6,719,423; and 6,761,446 refer to forming images on separate intermediates, then transferring the images in register to form a four-color image on a receiver. While these patents address the problem of excess fluid in a four-color image, the process of registration of the component images from separate intermediates involve complex and expensive mechanisms. The situation is further complicated if receivers of different thickness and/or surface properties need to be used. In addition, the receiver path to accommodate successive transfers to form the multi-color image is relatively long, affecting cost and reliability.

Thus, there remains a need for a simpler method of using ink jet printing to form high quality color images on a wide range of substrates, without the aforementioned limitations of prior art. In addition, there is a need for ink jet printing methods that provide combinations of print quality, speed, and cost which improve on the prior art.

Gravure printing is a well-known commercial process in which gravure ink is applied to a plate or roller, including a multitude of individual cells, corresponding to the image that is desired to be printed. Ink is applied via an applicator that typically has a doctor blade. A receiver (typically paper) is then pressed against the inked image and some of the ink, typically about 60% in each cell, is transferred to the receiver. An electrostatic field may be applied across the transfer nip to enhance transfer.

In order for a gravure ink to uniformly coat a gravure roller or plate (hereafter referred to as a gravure roller or gravure cylinder, with the understanding that either term is inclusive of a gravure plate), the viscosity of a gravure ink ranges from roughly 50 to 1,000 cpoise (measured under low shear conditions).

Gravure printing is ideal for high run length printing applications, but is not generally suitable for shorter runs. There are several reasons for this. Firstly, a gravure cylinder is made to correspond specifically to the image that is being printed. This is time consuming and expensive and must be amortized over many prints to yield suitable low cost prints. Secondly, there is no way to ink the roller in a fashion that would enable it to print variable data, such as would be the case in digital printing. Finally, gravure printing leaves approximately 40% of the ink behind in the gravure cylinder. This would create printing artifacts such as ghost images if the roller were used for variable data printing, unless the roller was first thoroughly cleaned. Cleaning the gravure roller thoroughly is a difficult but necessary process since any trace amounts of ink remaining within a cell, normally inconsequential in conventional gravure printing because the same image is printed repeatedly, is quite detrimental to subsequent prints where variable data streams are involved.

U.S. Pat. Nos. 6,767,092; 6,761,446; 6,719,423; and 6,682,189 disclose a device that prints an ink jet image onto the surface of an imaging member, fractionates the ink particles from the liquid, then removes some or all of the liquid before transferring the ink to paper. Devices of this type may lead to image blurring from liquid coagulation, or dot placement errors and satellites from the ink jet device. There is also a need to formulate separate pigmented inks for each color, leading to concerns about interactions between pigment particles and the ink jet print head since the ink jet device uses the different pigmented liquid for each color.

SUMMARY OF THE INVENTION

This invention is directed to making of an ink-based image using a non-marking ink in conjunction with a marking ink having electrically charged particles. The process allows for the production of gray scale and high-density images using digital technology. Moreover, as the image is produced with non-marking ink, identical ink jet heads can be used for each color station when making either full-color or sport color images. Finally, as this process does not require the jetted ink to dry, drying of the ink in the ink jet head is alleviated, thereby producing a more reliable digital printing engine.

According to this invention, an ink jet device selectively ejects droplets of non-marking liquid into cells of a printing member in a desired latent negative image pattern. Empty or partially empty cells of the printing member are filled with marking ink having the desired color to create a desired image by uniformly applying the marking ink over the imaging member having, partially or totally filled cells. The ink is then leveled into the partially or unfilled cells using a skive, roller, doctor blade, or other known method. The ink in each cell is then electrostatically fractionated using techniques such as those described in co-pending U.S. patent application Ser. No. 11/445,713. This is accomplished by applying an electrical bias between the imaging member and a fractionator. The fractionated marking ink is then electrostatically transferred to a receiver, leaving predominantly clear liquid in the printing member cells.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1A:
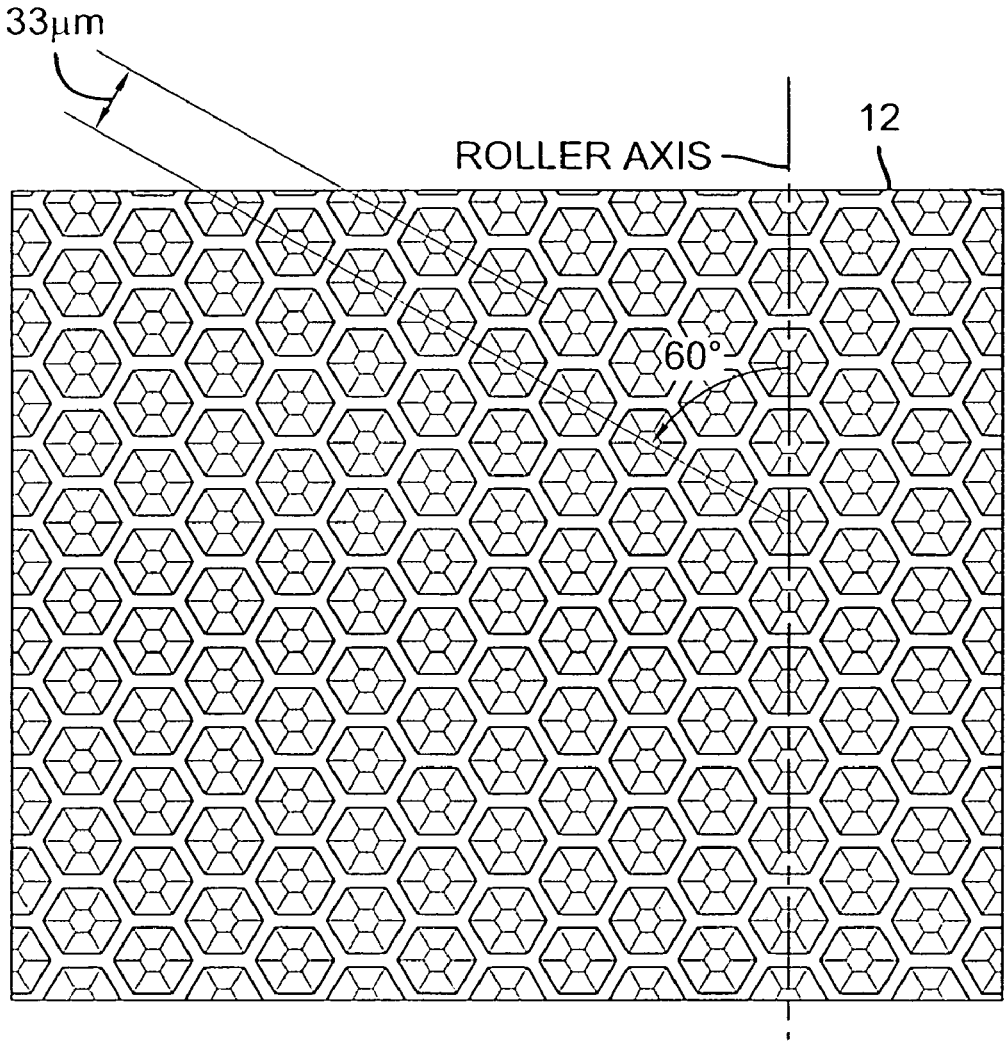
FIGS. 1*a* and 1*b* are views of a portion of a textured imaging member (TIM) and details of the cells thereof, for use in the printing apparatus according to this invention, on a significantly enlarged scale.

According to this invention, an ink jet mechanism is utilized to write an image, using a non-pigmented ink that is jetted into cells of a primary textured imaging member (TIM). The quantity of non-marking ink jetted into each cell varies, according to the negative image density of the image to be produced. Subsequent to the negative image-wise deposition of the non-marking ink, a marking ink of a chosen color is spread across the primary imaging member in such a manner as to fill the partially filled or unfilled cells of the TIM, thereby making a positive inked image. The preferred mode of filling the cells of the TIM with marking ink is to spread the ink using a roller, doctor blade, squeegee, or other known mechanism that is in intimate contact with the TIM, thereby forcing the marking ink into the partially filled or unfilled cells and skiving the ink off the TIM in all other areas.

In similar fashion, this technology can be used to produce digital binary images, i.e. those images where the amount of ink laid down per printed pixel is approximately constant and the density is varied by controlling the number of pixels that are printed. For example, in traditional printing, gray scale is obtained by printing a so-called half-tone pattern. In a typical offset or gravure printing, dots are printed according to a ruled grid, with the higher frequency rulings corresponding to higher quality images. For example, assume that an image is printed on a 150-line rule; that is, a grid in which ink can be deposited periodically with a spatial frequency of 150 dots per inch. The density is controlled, by varying the size of the dot printed on the aforementioned grid. If a white background is desired in a specific area, no ink is deposited at those grid positions corresponding to such specific area. If a solid area is to be developed, the printed dot would cover the entire area within that grid location. Gray scale is achieved by varying the size of the dots laid down on each grid location. For example, assume a 600 dpi printing press printing on a 150-line rule. That means that each grid mark is divided into an array of 4 pixels by 4 pixels. Each pixel can be either inked or left unlinked, thereby allowing 16 levels of gray to be printed. More pixels in an array will allow more gray levels to be printed. In a gravure press, the pixels on the imaging plate or cylinder will be varied to allow the dot size to vary. In a digital press, the number of inked pixels per grid mark determines the number of gray levels.

The present invention provides a solution to several serious limitations in ink jet printing. First, it eliminates ink jet head plugging by eliminating the need to jet inks that can either dry in, or otherwise clog, the heads. Second, in a color engine, it allows the same head to be used for each color as only clear solvent, not colored ink, is jetted. Third, it eliminates the cost and complications associated with formulating new inks for each application. Fourth, it allows the marking ink to be more viscous than inks have to have flow characteristics so as to be jettable. Fifth, inks having larger marking particles, which are easier to produce, but cannot be jetted from an ink jet head because such particles will clog the nozzles, can be used in this process, if desired.

Figure 1B:
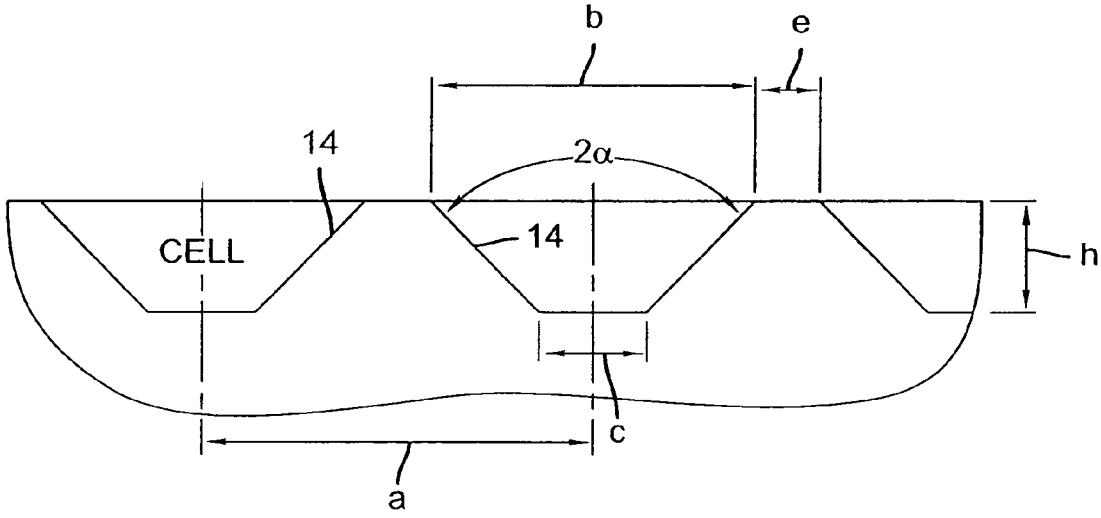

The TIM can include an endless belt, a roller, or other suitable member, such as a plate similar to a gravure plate typically used in the printing industry. However, in contrast to a typical gravure plate, wherein the cells are made to correspond to the image to be printed, in the present invention the cells are approximately uniform in size and distribution across the surface of the TIM. Certain anilox rollers having an electrically conductive member are suitable for use as a TIM. The texture of the TIM is specified so that the ink jet drops are contained in very small wells (cells) that are deep enough to fully contain any ink that is directed toward it. Referring to FIGS. 1*a* and 1*b*, a preferred exemplary structure for a TIM is shown (designated by numeral 12) where cells 14 are hexagonally shaped and closely packed. Of course other shapes for the cells 14, such as diamond, rectangular, or oval for example, are suitable for use with this invention. The structural relation of the cells 14 prevents ink deposited in the cells from coalescing, which blurs the image, by preventing the ink in the cells from migrating beyond the cell walls. The cells 14 can also correct satellites and jet errors by collecting ink drops within the cell walls.

To practice this invention, it is important that the TIM 12 include an electrically conducting element. For example, the TIM 12 can have a metal surface. This allows an electrical bias to be established across the inked cells. Suitable TIMs 12 are described in a co-pending application and includes anilox rollers, gravure rollers or plates, or semi-conducting elastomeric members.

It is also important that the marking ink include an electrically insulating solvent, for example, a hydrocarbon such as Isopar L, Isopar G, or Isopar M, sold by Exxon, or various mineral oils, soy oil, or various silicone oils. In addition, the ink should have marking particles that are electrically charged. The particles should preferentially be between 0.1 and 3.0 μm in diameter and include a colorant such as a pigment or dye, although particles without a colorant can be used if desired. The particles can also include a polymer binder that is insoluble in the solvent. Because the ink needs to be electrically insulating, water and certain short chain alcohols such as methanol, ethanol, and isopropanol are not suitable solvents.

Although it is necessary that the particles in the marking ink be charged, the actual sign and magnitude of that charge is not critical as long as the ink remains stable, i.e., does not coagulate at a rate that does not allow it to be used in the printing engine, and is sufficiently high as to allow transfer and fractionation. Typically, the charge can be determined by applying a DC electrostatic field across a pair or parallel electrodes and measuring the charge on the material that is plated onto one electrode. Preferably, the magnitude of the charge per unit volume of ink should be greater than approximately $10^{-7}$ C/cm$^3$.

The non-marking ink may include a solvent similar to that used in the marking ink. Alternatively, the non-marking ink may have a hydrophilic solvent such as water, or short chain alcohols, for example. This will prevent the two inks from mixing and may facilitate fractionation and transfer, providing the size of the cells of the TIM 12 is sufficiently large as to prevent the hydrophobic solvent from displacing the hydrophilic solvent. The electrical resistivity and other physical description of the marking ink are given in co-pending U.S. patent application Ser. No. 11/445,713, and incorporated by way of reference.

In the practice of this of the invention, the non-marking ink is image-wise jetted into cells of the TIM 12, partially or totally filling those cells corresponding to a negative of the image that is to be printed. The marking ink is then spread over the TIM 12 and skived, rolled, or otherwise removed, thereby leaving just enough ink so as to fill each cell. The marking particles, within the marking ink, is then fractionated electrostatically using technology such as described in co-pending U.S. patent application Ser. No. 11/445,713 and electrostatically transferred to a receiver. The receiver can be a transfer intermediate member, preferably having a compliant member, such member having a Young's modulus between 1 MPa and 10 MPa and being between 0.1 mm and 10.0 mm thick. The Young's modulus is determined using an Instron Tensile Tester and extrapolating back to zero strain. The applied bias used to effect both transfer and fractionation depends on the resistivity of the opposing electrode. Typically, transfer and fractionation voltages range between approximately 100 volts and 2,000 volts.

In another embodiment of this invention, the marking ink can be jetted into specific cells. While this process has the advantage of limiting the amount of marking ink deposited into undesirable locations on the TIM 12, it may be more susceptible to clogging the ink jet nozzle, thereby being a less robust process. Moreover, the additional jetting process is slow compared to uniformly depositing the marking ink, thereby limiting the speed at which the press can operate.

The receiver can also be the final receiver that is to bear the image, such as paper. In this mode of practicing the invention, the electrical bias can be established using an electrode such as a roller located behind the paper in such a manner as to press the paper against the TIM 12. Alternatively, a bias can be established by other suitable mechanisms such as a corona or a corona in conjunction with a roller. In another alternative mode of practicing this invention, fractionation and transfer can be done simultaneously. Also, TIM 12 can be cleaned after transfer using various devices such as spraying with a solvent that readily evaporates, spraying with compressed air, a combination of the aforementioned mechanisms, or other suitable devices known in the art.

Figure 2:
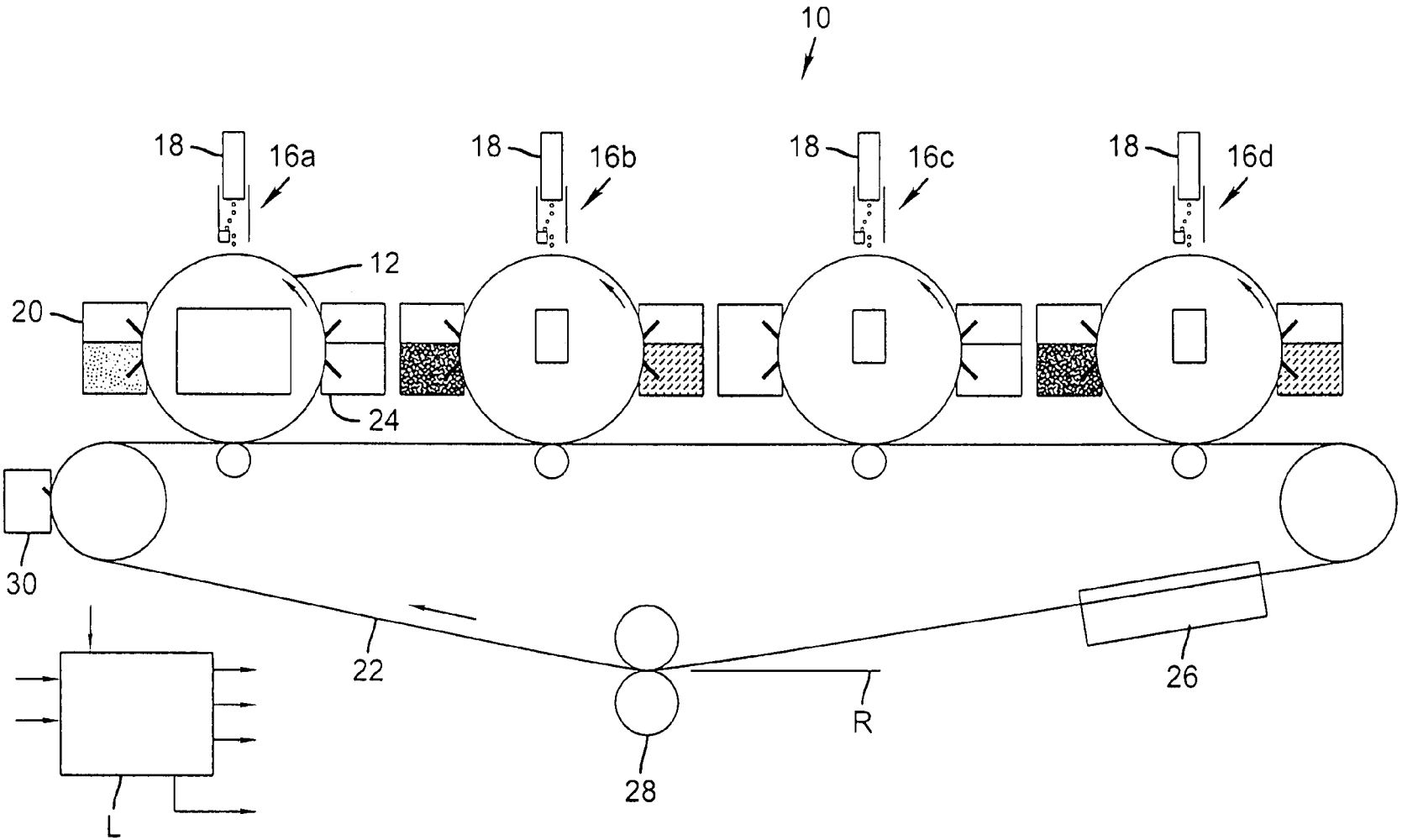
FIG. 2 is a schematic illustration of a preferred embodiment of the printing apparatus according to this invention.
Figure 3:
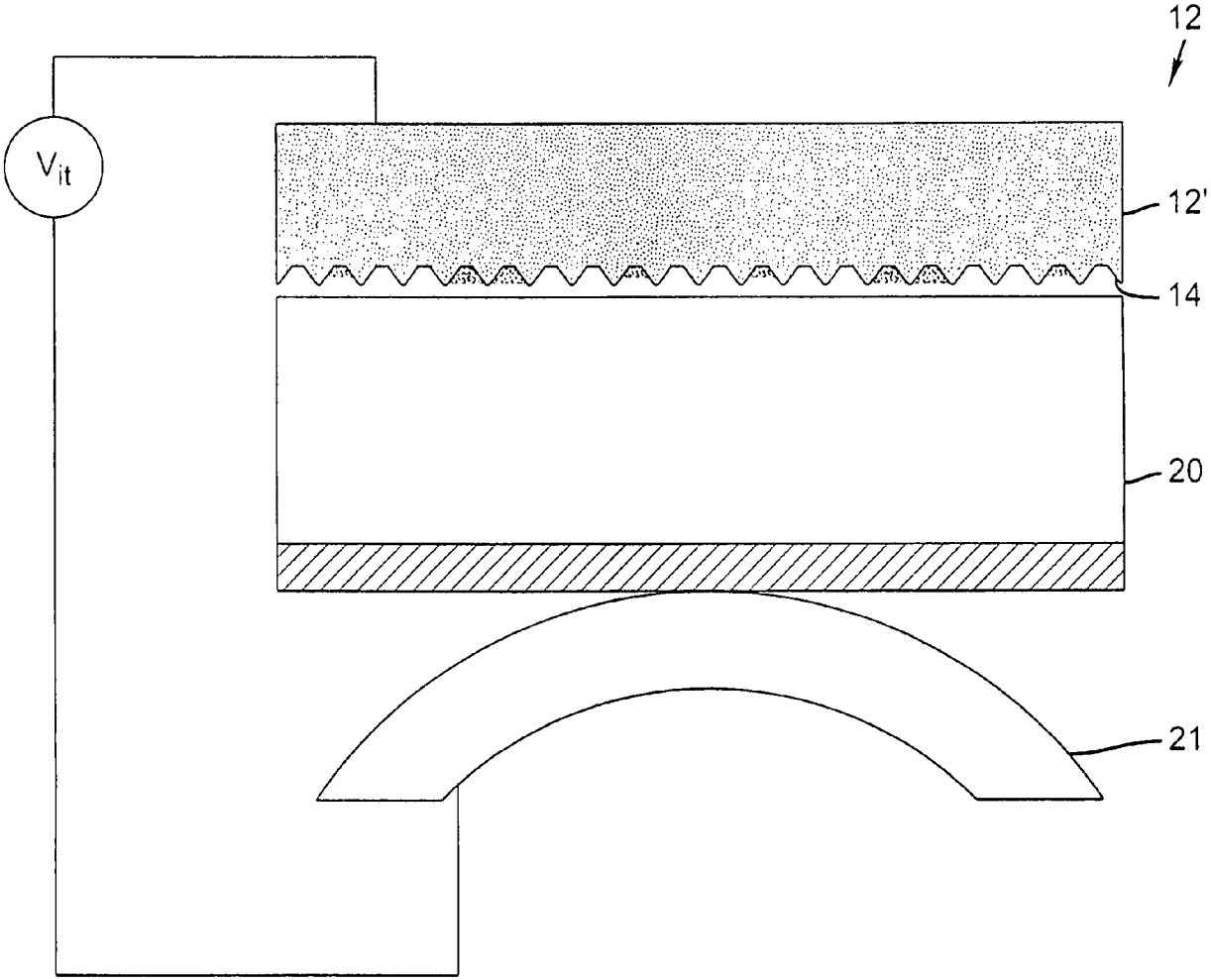
FIG. 3 is a side view, in cross-section of a portion of the anilox roller and intermediate member of the printing apparatus according to this invention.
Figure 4:
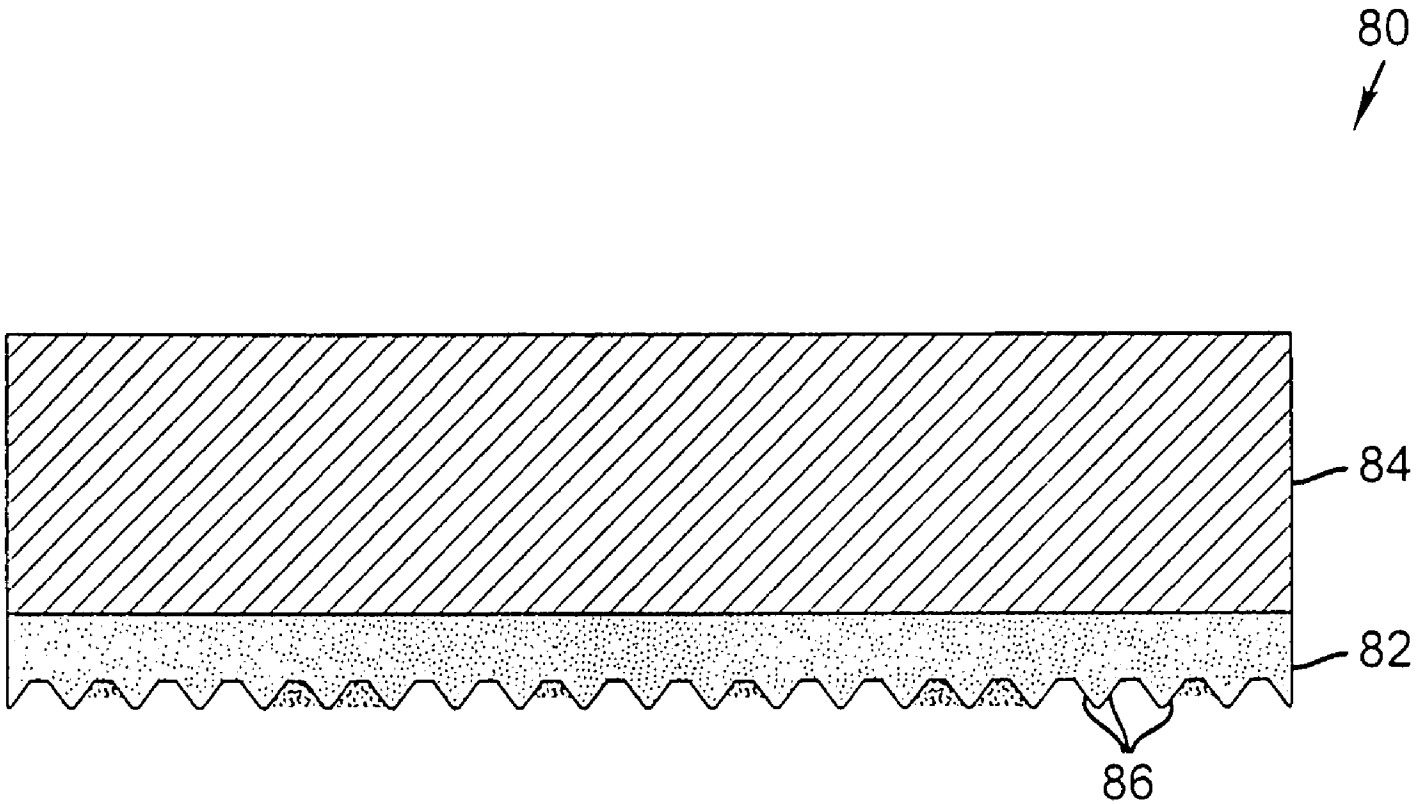
FIG. 4 is a side view, in cross-section of a portion of an alternate embodiment of the anilox roller of the printing apparatus according to this invention.

A first preferred embodiment of a printing apparatus 10, according to this invention, is shown in FIG. 2. The TIM 12 is shown as an anilox roller (with hexagonally shaped, closely packed cells 14 as shown in FIG. 1). For the reasons set forth below the anilox roller must have an electrode. As shown in FIG. 3, the anilox roller 12 may be a steel roller 12' (alternatively may be chrome coated), thus making electrical contact straightforward. That is, the anilox roller 12 is grounded and an intermediate member 22, further described below, in contact therewith, has an applied electrical bias connected thereto, such as voltage source V. Alternatively, the anilox roller, for example designated by the numeral 80 in FIG. 4, may have a structure where a ceramic layer 82 is formed on top of steel (conducting) substrate 84. The ceramic layer 82 is etched (for example with a high powered laser) to form the cells 86. In this case, the ceramic layer 82 is to be relatively thin, i.e., about twice the depth of the etched cell. The steel substrate 84 would then serve as the electrical contact.

Four basic, substantially identical imaging units, designated as 16*a*-16*d*, are shown in the embodiment of FIG. 2. More or less imaging units may be used if it is desired to create monochrome prints, two or three spot color prints, or process color prints with four or more color separation images, with or without additional spot color separations. Each of the imaging units 16*a*-16*d* includes an ink jet device 18 that selectively jets a non-pigmented ink in an image-wise fashion on to the TIM (anilox roller) 12 thereby creating a negative latent image in the cells 14 on the surface of the respective TIM 12. An inking unit 20 is provided a marking particle in layer, spread on the surface of the TIM 12 to top off all cells 14 that are empty, or partially empty, with a pigmented ink. The image is thereafter fractionated and transferred to an intermediate member 22, which is preferably compliant. A preferred intermediate member 22 has a volume resistivity between $1.0\times10^{8}$ and $1.0\times10^{11}$ ohm-cm. The intermediate member 22 could be a roller or a web. If the intermediate member is a roller, then the support layer should include an electrically conducting cylinder (aluminum, steel core) and the thickness of the compliant layer would preferably be greater than 1.0 mm and less than 15.0 mm. If the intermediate member is a web, then the support material is preferably a seamless web having a metal layer such as nickel, steel, or such. Alternatively, a thin electrically conducting film can be coated onto a polymer web. Suitable polymers include polyimide, polyester, or polycarbonate for example. As shown in FIGS. 2 and 3, the applied electrical bias (from voltage source V) is applied by conducting rollers 21 engaging the intermediate member web 22 with the anilox rollers 16*a*-16*d*. A conditioning unit 24 cleans the cells 14 of the TIM 12 after transfer in order to ready them for receiving the next image. Each imaging unit 16*a*-16*d* creates one color separation image, which individual color separation images are combined in register on the intermediate member 22 to form a desired multi-color image. An optional liquid removal unit 26 is shown that acts to remove excess liquid from the imaged intermediate member 22. The liquid depleted image carried by the intermediate member 22 is then transferred to a receiver member R (paper or other media) in a transfer zone 28, and the intermediate member 22 is cleaned by a cleaning unit 30 prior to re-entrance into operative relation with the imaging units 16*a*-16*d*.

Activation and timing of operation of the various elements of the printing apparatus 10, according to this invention, are controlled by a logic and control device L. The logic and control device L is preferably a microprocessor-based device, which receives input signals from an operator communication interface, and a plurality of other appropriate sensors (not shown) associated in any well-known manner with the elements of the printing apparatus 10. Based on such signals and suitable programs for the microprocessors, the logic and control device L produces appropriate signals to control the various operating devices and stations within the printing apparatus 10. The production of a program for a number of commercially available microprocessors is a conventional skill well understood in the art, and do not form a part of this invention. The particular details of any such program would, of course, depend upon the architecture of the designated microprocessor.

Figures 5A, 5B, 5C, 5D:
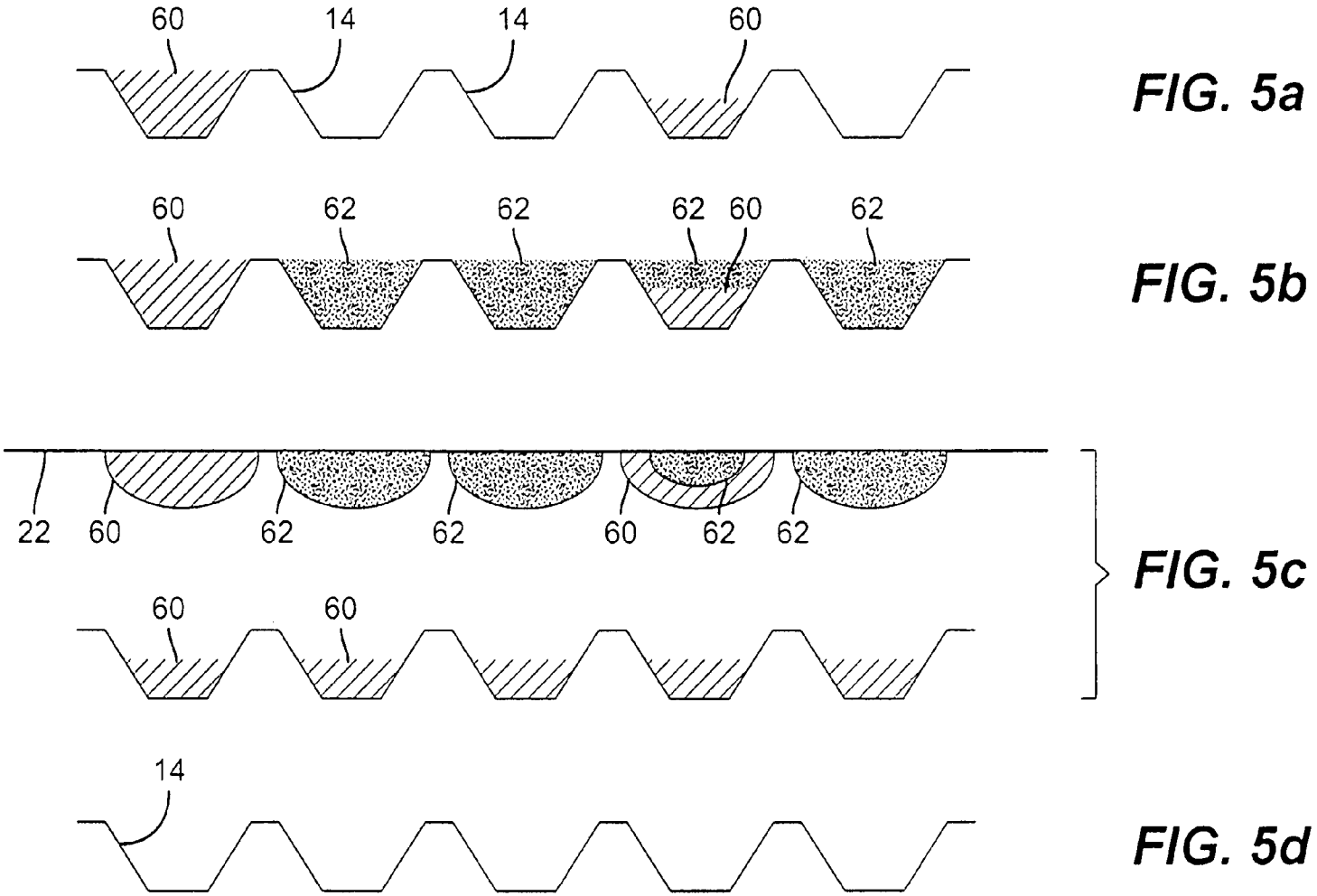
FIGS. 5*a*-5*d* are respective views, in cross-section, showing the sequential operation of the printing apparatus according to this invention as seen in FIG. 2.

The method of operation for image formation by the printing apparatus 10 is sequentially shown in FIGS. 5*a*-5*d*. FIG. 5*a* shows non-pigmented liquid 60 from ink jet device 18 filling selective cells 14 of the TIM 12 in an image-wise fashion that is a negative of the image to be created. Cells 14 can be partially filled, or completely filled, depending on the level of gray being implemented. FIG. 5*b* shows the state of the cells 14 after the TIM 12 passes through the inking unit 20. The inking unit 20 fills empty and partially empty cells with a pigmented ink 62, while the previously fully-filled cells remain filled only with non-pigmented liquid. The TIM 12 is then moved into contact with the intermediate member 22 and an electrical bias is applied to fractionate and preferentially transfer pigmented ink 62 to the intermediate member, leaving mostly liquid 60 behind in the cells 14 after the splitting of the pigmented ink has occurred. The resulting image transferred to the intermediate member 22 in this manner (as shown in FIG. 5*c*), possibly with some of the pigment-depleted liquid from the TIM cells 14. FIG. 5*d* shows the state of the TIM after the conditioning unit 24 cleans the cells 14 and removes any remaining liquid 60.

Figure 6:
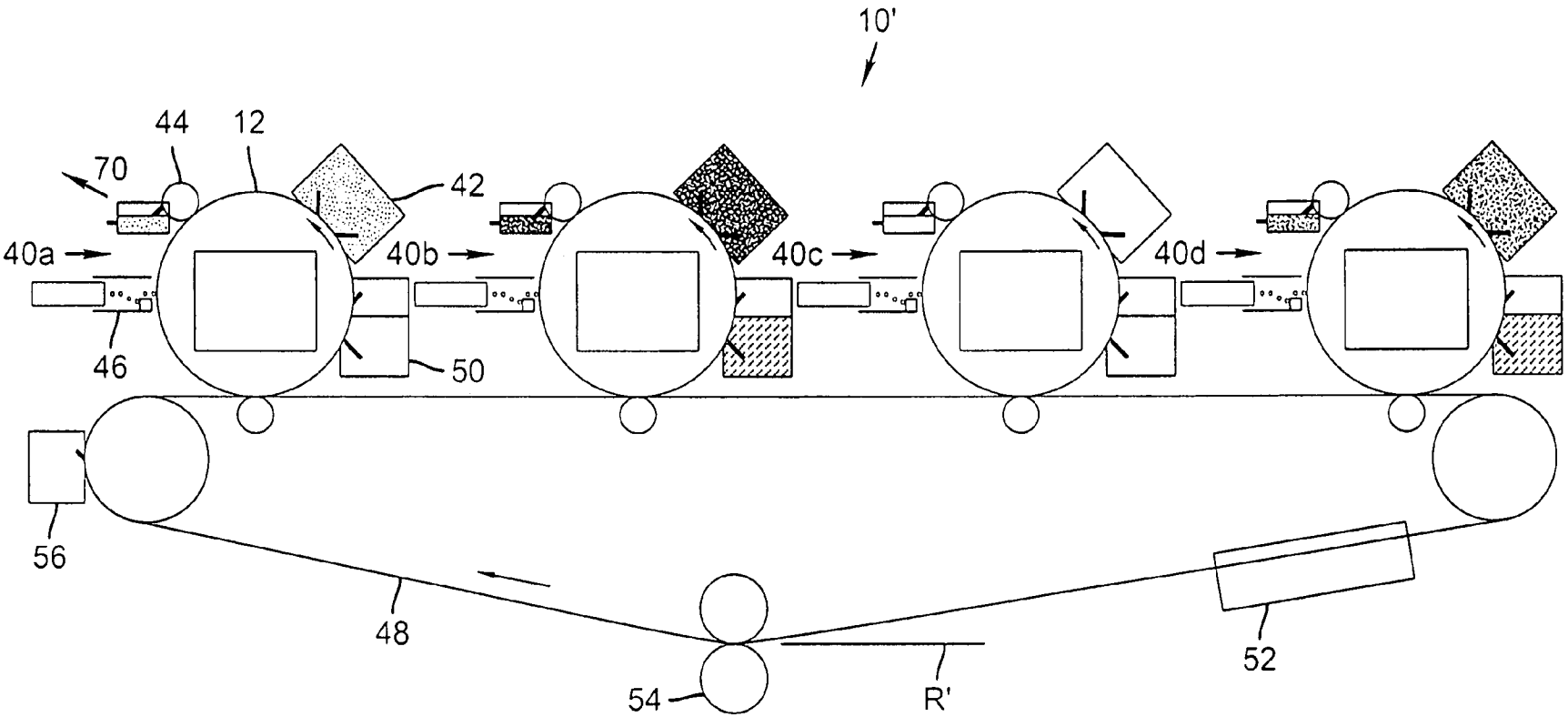
FIG. 6 is a schematic illustration of another preferred embodiment of the printing apparatus according to this invention.
Figures 7A, 7B, 7C, 7D, 7E:
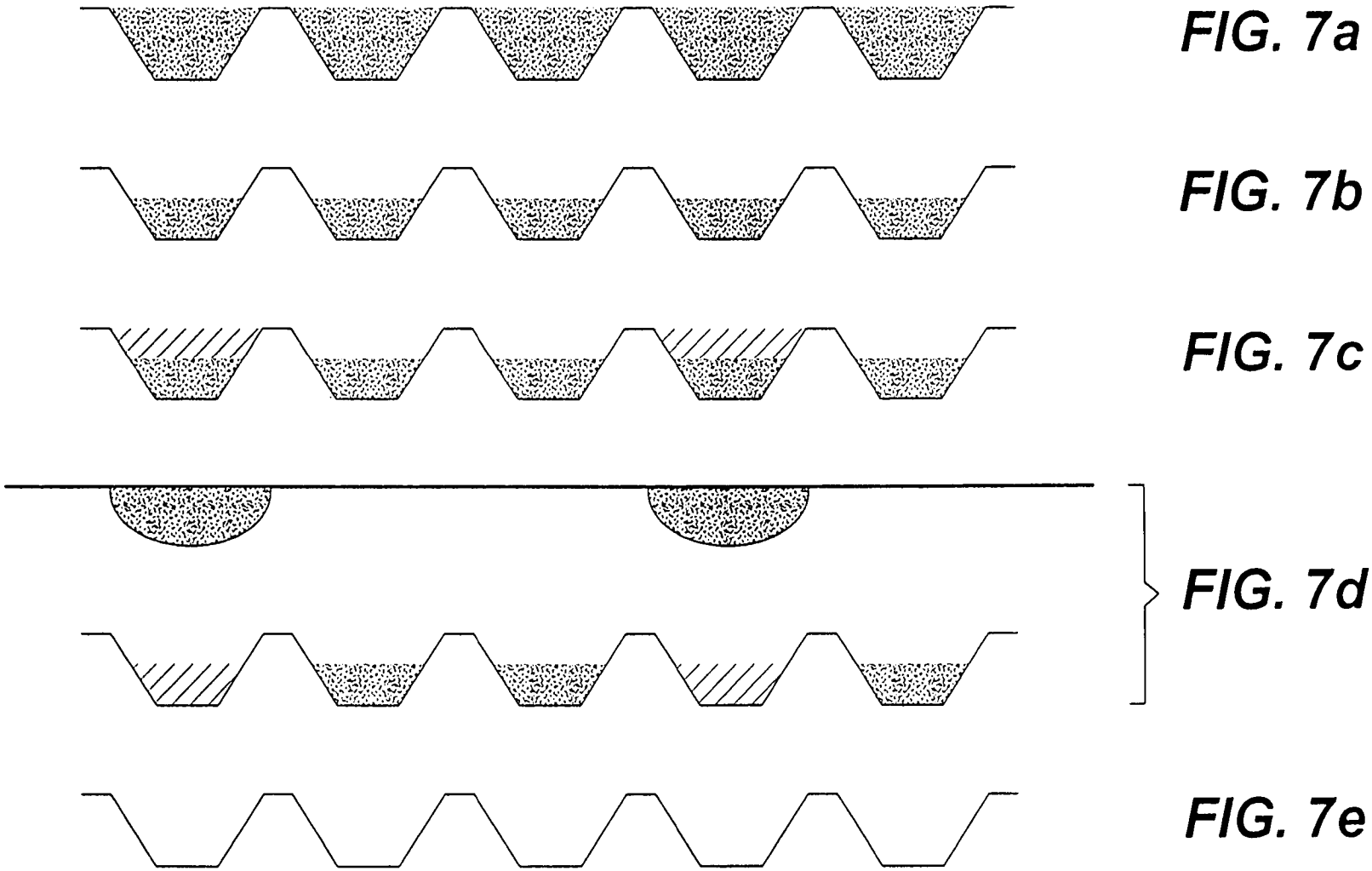
FIGS. 7*a*-7*e* are respective views, in cross-section, showing the sequential operation of the printing apparatus according to this invention as seen in FIG. 4.

A second preferred embodiment of the printing apparatus 10', according to this invention, is shown in FIG. 6. The TIM 12' is shown as an anilox roller (with hexagonally shaped, closely packed cells 14'). Four basic, substantially identical imaging units designated as 40*a*-40*d* are shown. More or less imaging units may be used if it is desired to create monochrome prints, two or three spot color prints, or process color prints with four or more color separation images, with or without additional spot color separations. Each of the imaging units 40*a*-40*d* includes an inking unit 42 to uniformly apply a pigmented ink 70 to the TIM 12', filling all of the cells 14' thereof equally (FIG. 7*a*). Thereafter, a roller 44 is provided that is suitable for removing a portion of the ink 70, typically about one half of the ink, from the cells 14' (see FIG. 7*b*) and returns the ink to the inking unit 42. In order of process, an ink jet unit 46 is provided to then jet a non-pigmented liquid in an image-wise fashion onto the TIM 12', thereby selectively filling the cells 14' on the surface of the TIM in an image-wise manner (FIG. 7*c*). That is, only the cells that correspond to an image to be printed are completely filled. The resultant image is fractionated and transferred to an intermediate member 48, which is preferably compliant. After transfer, a conditioning unit 50 cleans the cells 14' to ready them for receiving inks for forming the next image. Each imaging unit 40*a*-40*d* respectively creates one color separation, which is combined in register on the intermediate member 48 with the other color separations. An optional liquid removal unit 52 is shown that acts to remove excess liquid from the imaged intermediate member 48. The liquid-depleted image is then transferred to a receiver member R' (paper or other media) in a transfer zone 54, and the intermediate member 48 is thereafter cleaned by a cleaning unit 56 prior to re-entrance into the imaging units 40*a*-40*d*. The inked image can be transferred from the intermediate to the final receiver (e.g. paper) by bringing the paper into contact with the intermediate using known transport mechanisms and applying an electrostatic field that urges the charged particles from the intermediate member 48 to the receiver R' while the final receiver R' is in contact with the intermediate member 48. Alternatively, the inked image can be transferred from the intermediate member to a final receiver by pressing the intermediate member against the final receiver, preferably with the simultaneous application of heat, i.e., using a pressure or thermal transfer, as is know in the electrophotographic literature. Moreover, a thermal transfer process can be utilized so that the inked image is transferred and fused simultaneously in a process known in the literature as transfusion.

The method of operation for image formation by the printing apparatus 10' is sequentially shown in FIGS. 7*a*-7*e*. FIG. 7*a* shows the inking unit 42 filling all the cells 14' of the TIM 12' uniformly with pigmented ink 70. FIG. 7*b* shows the half-filled cells, resulting from ink splitting by the roller 44. FIG. 7*c* shows the cells 14' filled in an image-wise manner, from the ink jet unit 46, with a non-pigmented compatible liquid 72. The TIM 12' is then moved into contact with the intermediate member 48 and the liquid is fractionated transferring about half of the filled cells 14' to the intermediate member 48, and not transferring any ink from the non-image (half-filled) cells. When an electrical bias is applied during this transfer, the pigmented particles are fractionated and preferentially transferred to the intermediate member 48, leaving mostly liquid 72 behind in the cells after the splitting of the ink has occurred. The resulting image transferred in this manner is shown in FIG. 7*c*, along with the pigment-depleted liquid in the TIM 12'. FIG. 7*d* shows the state of the TIM 12' after the conditioning unit 50 cleans the cells and removes most or all of the remaining liquid 72.

The invention has been described in detail with particular reference to certain preferred embodiments thereof, but it will be understood that variations and modifications can be effected within the spirit and scope of the invention.

PARTS LIST

10, 10' Printing apparatus
12, 12' Textured imaging member (TIM)
14, 14' Cells
16*a*-16*d* Imaging units
18 Ink jet device
20 Inking unit
21 Conducting rollers
22 Intermediate member
24 Conditioning unit
26 Removal unit
28 Transfer zone
30 Cleaning unit
40*a*-40*d* Imaging units
42 Inking unit
44 Roller
46 Ink jet unit
48 Intermediate member
50 Conditioning unit
52 Removal unit
54 Transfer zone
56 Cleaning unit
60 Liquid
62 Pigmented ink
70 Ink
72 Liquid
80 Anilox roller
82 Ceramic layer
84 Steel substrate
86 Cells
L Logic and control device
R, R' Receiver member
V Voltage source

What is claimed is:

1. A printing apparatus utilizing non-marking liquid ink and marking pigmented ink, said printing apparatus comprising:

a printing member including a series of substantially equal sized cells located over the surface of said printing member and having a depth relative to said surface of said printing member;

an inking unit for filling cells of said printing member with pigmented ink having electrostatically charged particles to form a substantial blanket of pigmented ink on said printing member;

an ink jet device for selectively ejecting droplets of non-marking liquid ink into certain of said cells of said printing member in a desired negative latent image pattern;

a transport for a receiver for transporting said receiver into operative association with said printing member; and a transfer mechanism for fractionating said pigmented ink only in those cells not including non-marking liquid ink in the negative image pattern, including an electrical bias device for facilitating fractionating of said pigmented ink, and transferring such fractionated pigmented ink to said receiver.

2. A printing apparatus according to claim 1, wherein the receiver is paper.

3. A printing apparatus according to claim 1, wherein said transfer mechanism includes an intermediate member.

4. A printing apparatus according to claim 1 comprising:

a transport device for transporting a receiver into operative association with said intermediate member;

a first transfer mechanism between said intermediate member and said printing member to fractionate said pigmented ink from said non-marking liquid and transfer an image-wise pigmented ink pattern from said printing member to said intermediate member, leaving behind a substantial portion of such liquid; and a second transfer mechanism between said intermediate member and a receiver member to transfer an image-wise pattern from said printing member to such receiver, while such receiver is in operative association with said intermediate member.

5. The printing apparatus of claim 4, wherein said first transfer mechanism includes an electrical bias device for facilitating fractionating of said pigmented ink.

6. A printing apparatus according to claim 4, wherein said second transfer mechanism provides for electrostatically transferring said ink pattern from the intermediate member to the final receiver.

7. A printing apparatus according to claim 4, wherein said second transfer mechanism provides for thermally transferring said ink pattern from the intermediate member to the final receiver.

8. A printing apparatus according to claim 4, wherein said second transfer mechanism provides for transferring said ink pattern from the intermediate member to the final receiver by the application of pressure.

9. A printing apparatus according to claim 4, wherein said second transfer mechanism provides for thermally transferring and fusing said ink pattern from the intermediate member to the final receiver.

10. The printing apparatus of claim 1, wherein said printing member is a roller with said cells located substantially over the entire circumferential surface of said roller in a closely packed, hexagonal configuration.

11. The printing apparatus of claim 1, wherein said printing member is a roller with said cells located substantially over the entire circumferential surface of said roller in a closely packed configuration.

12. The printing apparatus of claim 11, wherein configuration is selected from the group of configurations including hexagonal, diamond, rectangular, and oval shapes.

13. The printing apparatus of claim 11, wherein said inking unit fills all cells of said printing member.

14. The printing apparatus of claim 13, wherein said certain cells of said printing member filled by said inking member are all cells thereof and further including an ink removing mechanism located downstream, in the process direction, of said inking unit for removing approximately half of said pigmented ink from all cells of said printing member.

15. The printing apparatus of claim 14, wherein said ink removing mechanism also removes ink that is not within a cell.

16. The printing apparatus of claim 15, wherein said ink removing mechanism is a squeegee, a skive, or a roller.

17. The printing apparatus of claim 16, wherein said ink removing mechanism is operatively connected to said inking unit to return removed ink thereto.

18. The printing apparatus of claim 1 further including a cleaning unit in association with said printing member, wherein any liquid remaining in said cells of said printing member is removed prior to reuse.

* * * * *